US005906059A

United States Patent [19]

Singer et al.

[11] Patent Number: 5,906,059

[45] Date of Patent: May 25, 1999

[54] COMPOSITE CLEAT FOR ATHLETIC SHOE

[75] Inventors: Joel A. Singer, Quincy; Kenneth Santos, Taunton, both of Mass.

[73] Assignee: Lisco, Inc.

[21] Appl. No.: 08/922,822

[22] Filed: Sep. 3, 1997

[51] Int. Cl.[6] ..... A43B 23/28; A43C 15/00

[52] U.S. Cl. ..... 36/134; 36/67 D; 36/67 R; 36/61

[58] Field of Search ..... 36/67 R, 67 A, 36/67 D, 61, 127, 134

[56] References Cited

U.S. PATENT DOCUMENTS

| | | | |
|---|---|---|---|
| 1,072,794 | 9/1913 | Tradesco . | |
| 2,677,905 | 5/1954 | Dye | 36/134 |
| 3,656,245 | 4/1972 | Wilson | 36/67 D |
| 4,014,114 | 3/1977 | Jordan et al. | 36/67 D |
| 4,043,026 | 8/1977 | Semon | 36/134 |
| 4,146,979 | 4/1979 | Fabbrie | 36/67 D |
| 4,366,632 | 1/1983 | Bente | 36/67 D |
| 4,466,205 | 8/1984 | Corbari | 36/134 |
| 4,715,133 | 12/1987 | Hartjes et al. | 36/127 |
| 4,833,796 | 5/1989 | Flemming | 36/134 |
| 5,259,129 | 11/1993 | Deacon et al. | 36/127 |
| 5,293,701 | 3/1994 | Sullivan | 36/114 |
| 5,533,282 | 7/1996 | Kataoka et al. | 36/134 |

*Primary Examiner*—M. D. Patterson

[57] ABSTRACT

A composite, long wearing, slip-resistant non-metal golf cleat that alleviates damage to grass, e.g., the surface of a golf green, yet provides traction similar to conventional metal spikes is disclosed. The cleat provides a slightly higher, rounded, softer center core or tip which provides a measure of slip-resistance when walking on most hard, smooth dry surfaces and a firmer disk portion having multiple wing-shaped extensions to provide traction on turf surrounds the softer center.

30 Claims, 2 Drawing Sheets

COMPOSITE CLEAT FOR ATHLETIC SHOE

BACKGROUND OF THE INVENTION

1. Field of the Invention

The present invention relates to a cleat for an athletic shoe that provides both traction on greens and on hard smooth surfaces in a substantially non-penetrating manner, and particularly to a non-metal cleat having dual traction elements of different hardness including a center region that is less dense than the surrounding portion of the cleat.

2. Background

Spikes or cleats for athletic shoes have long been used to provide traction in dirt and grass. Such spikes or cleats typically have been made of metal or other relatively hard materials. However, various structures for cleats have been suggested including cleats having a hard metal center surrounded by an elastomeric material.

It was often found when using non-metal cleats on athletic surfaces, particularly artificial turf, that the cleats of an athletic shoe would be subject to increased wear do to the harder surface. In order to combat such wear, cleats were made with a harder insert supported by a relatively softer cleat body. Flemming (U.S. Pat. No. 4,833,796) discloses one such example of such an arrangement. In this arrangement, a relatively stiff elastic cleat body holds a ceramic insert. In this manner, the ceramic portion, which is relatively very hard, makes contact with the playing surface, while the supporting stiff elastic cleat body allows for flexibility and therefore less stressful dynamic loading of the athlete's foot.

Flemming's cleat, however, does not solve a problem often encountered by golfers. That is the need to walk not just over greens, but also over smooth hard surfaces peripheral to the playing area. Like traditional metal cleats, on a hard smooth surface, the Flemming cleat provides little traction and also does not address the additional problems of scratching the surfaces that are walked on, which in some areas peripheral to a golf course is of some concern.

A further problem is pointed out by Deacon et al. (U.S. Pat. No. 5,259,129). In the winter months, present day golfers are frequently not allowed to wear penetrating cleats so as not to damage the grass on the course. Deacon proposes a non-metal disk-shaped winter cleat insert for a pair of golfing shoes in order to replace the conventional metal spikes that provide traction on turf without penetrating or damaging the grass. These inserts, however, are not designed for walking on hard surfaces, and doing so wears rapidly on the radial gripping ridges and decreases traction during a golf swing.

Thus, improvements in cleats for athletic shoes, and particularly for golf shoes, are still being sought.

SUMMARY OF THE INVENTION

The present invention provides a cleat comprising a stud with a composite body for an athletic shoe that provides traction both on hard smooth surfaces and on greens in a relatively non-penetrating manner. In accord with the instant invention, an exchangeable cleat having a non-metal body is provided. The non-metal body is formed of a material having a first durometer and has a central portion formed of a material having a second durometer, the first durometer being harder than the second durometer. The softer central portion preferably extends from a disk-shaped element of relatively harder material a short distance in a direction away from the sole of an athletic shoe, allowing a gripping central area for walking on harder surfaces. The wider, firmer disk area provides traction on the turf, for example, during a golf swing.

In further accord with the invention, the removable cleat can be used year-round in golf without sacrificing performance and while providing damage avoidance to greens.

The invention also includes athletic shoes provided with a plurality of composite cleats. Preferably, the cleats have a body that is long wearing and slip resistant by utilizing various polymers and/or plastics. The non-metal, softer central portion preferably extends only a short distance beyond a firmer surrounding turf-gripping portion, and the composite construction provides non-penetrating but effective traction, e.g., during a golf swing.

In preferred embodiments of the invention, the materials are selected to provide a long wearing, slip-resistant, non-metal cleat that alleviates damage to the surface of a golf green, yet provides traction on grass and wear similar to conventional metal spikes. By the term "non-metal" cleat in accord with the present invention, we mean a cleat wherein the surfaces contacting the ground are not metal. However, cleats of the invention can have a metal stud base for attachment to the sole plate of a shoe.

BRIEF DESCRIPTION OF THE DRAWINGS

These and other features and advantages of the present invention will become more apparent in view of the following detailed description in conjunction with the accompanying drawings, of which.

DETAILED DESCRIPTION OF THE INVENTION

Figure 1:
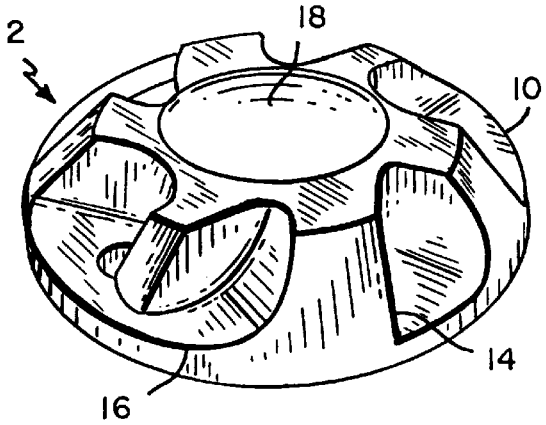
FIG. 1 is a perspective view of a cleat for athletic shoes in accord with one embodiment of the present invention.
Figure 2:
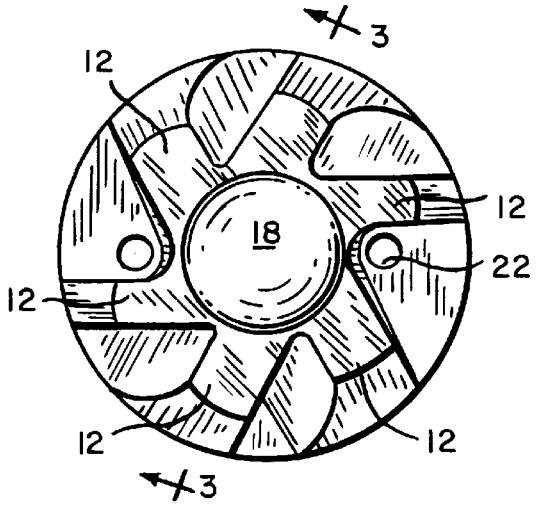
FIG. 2 is a top view of the cleat of FIG. 1.
Figure 3:
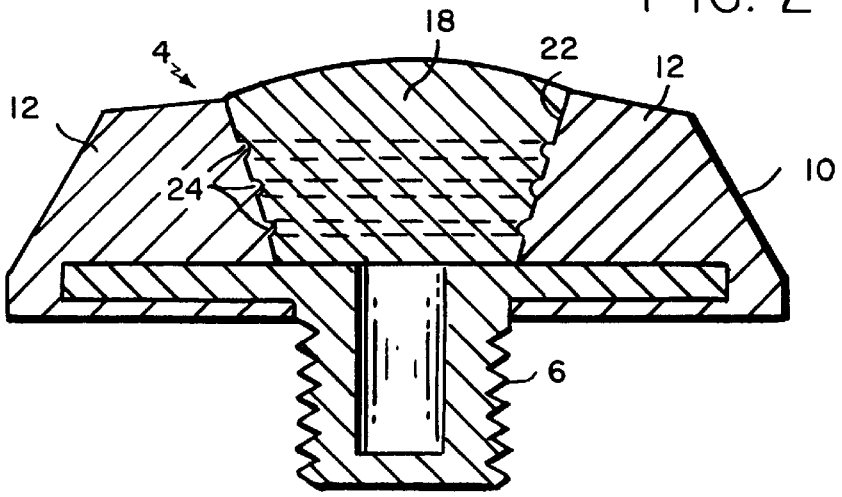
FIG. 3 is a section view of a composite cleat taken along line 3—3 of FIG. 2.

Referring now to the drawings, a non-metal composite cleat (2) is illustrated in FIGS. 1–3. The cleat is held to the sole of an athletic shoe by an integral stud (4). As shown in the illustrative embodiment, stud (4) preferably comprises external mounting thread (6), allowing the stud (4) to be turned into one of several matingly threaded mounts in the sole of a shoe. A mounting tool engages the cleat body (2) at tool fittings (20) to allow the cleat to be firmly rotated into tight engagement within the internally threaded mount of the shoe sole plate.

Figure 4:
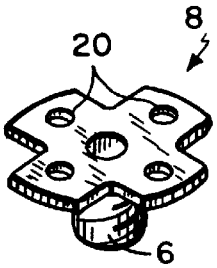
FIG. 4 is an isometric view of a cloverleaf stud base according to one illustrative embodiment of the invention.
Figure 5:
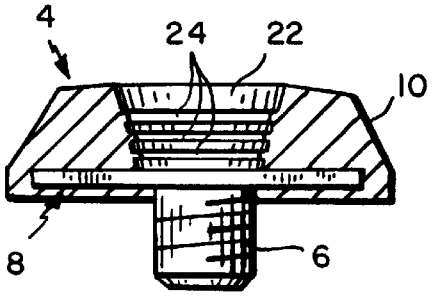
FIG. 5 is a cutaway view of a cloverleaf stud base and molded disk portion according to one illustrative embodiment of the invention.
Figure 6:
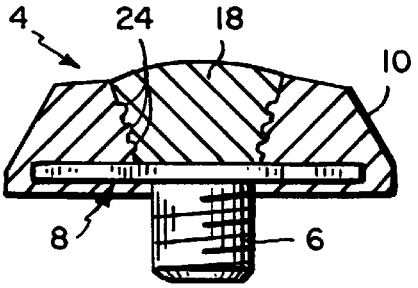
FIG. 6 is a cutaway view of a cleat for athletic shoes according to one illustrative embodiment of the invention.

In an illustrative embodiment of the instant invention, the cleat is molded in two steps about a metal clover-shaped or "cloverleaf" base (8) as depicted in FIG. 3. In the first step, a disk portion (10) is molded about the base (8) to provide an intermediate component as depicted in FIG. 2. Disk (10)

is shaped with a plurality of gripping sections (12), which are constructed and arranged to grip the turf, e.g., of a golf course during the player's swing, and prohibit slipping of the sole of the golf shoe. The disk portion preferably is also molded to form tool fittings (20), so as to correspond to two of the cloverleaves of base (8) as depicted in FIG. 4. As detailed further in the cross sectional view of FIG. 5, a frustoconical cavity (22) is formed in the molding process at the center of the disk (10) surrounded by the wings (12). In a second molding step, a center portion (18), is formed preferably protruding from the upper major surface of the disk as depicted in FIG. 6. In use, the upper, or second, major surface is the ground-contacting surface. The frustoconical cavity (22) may further have ribs or threads (24) on the surface in order to aid in the retention of the center portion (18). As depicted, the frustoconical cavity (22) is convex to aid in the molding process, but can be concave or cylindrical. The relative geometric shapes of the disk portion (10) and the center portion (18) can have any mating shape, subject only to the desire of the designer and the ability to manufacture the part.

In another foreseen embodiment, the body of the cleat comprises a base which is attached to stud (4) and supports disk (10) at a major surface thereof. In this foreseen embodiment, the stud, base, and disk portions are formed integrally. As with the first illustrative embodiment, a center portion (18), preferably protruding from the upper major surface of the disk, is located within the disk.

In both of the aforementioned illustrative embodiments, the gripping sections (12) are raised from the base (8), and extend from the center portion (18) to the outer edge of the disk (10). In the illustrative embodiment, the circumference of the disk (10) is shown to comprise a shoulder area, rendering the disk a horizontal frustoconical section. In the illustrative embodiment, a typical gripping section (12) has a straight wall (14) that joins the base at an angle with respect to the base (8) and a rounded fillet, opposite to the straight side, which joins an upper horizontal surface of the gripping section (12) and curves down toward the base 8 joining the straight side wall of an adjacent gripping section 12. Each gripping section extends outward from the center section 18 to the circumference of the disk.

Preferably, the gripping section has an edge formed by the top horizontal surface of the disk and the straight wall. The edge preferably extends from the center portion (18), along a tangent to the rounded center portion, to the outer diameter of the disk. In the region of the cleat, in which the tool fittings are located, segments having two substantially straight walls can be located to facilitate access to and use of the tool fittings.

In the illustrative embodiments, the slightly higher, preferably rounded, center portion (18) is made of a material having a durometer softer than the material used to make the disk. The softer durometer of the center portion can provide slip resistant when walking on most hard, smooth, dry surfaces.

Preferably, the durometer of the disk portion of the body is between about 60–67 on the Shore A scale (10 sec delay). More preferably the durometer is in the range of 55 to 75 on the Shore A scale (10 sec delay). The center portion preferably has a durometer of about 55–62 on the Shore A scale (10 sec delay). More preferably the durometer is in the range of 49–65 on the Shore A scale (10 sec delay). The disk portion may be comprised of elastomers, plastics or other polymers and typically has a specific gravity of about 0.99 g/cc, more preferably in the range of 0.89–1.09 g/cc. The center portion may be comprised of elastomers, plastics or other polymers and typically has a specific gravity of about 0.95 g/cc, more preferably in the range of 0.85–1.05 g/cc. The center portion also preferably has a slip resistance equivalent to or better than 1.11/1.11 (dry/wet) on vinyl tile in accord with ASTM F-489, and an NBS abrasion index of about 175 or better. The disk portion is typically of a material having an NBS abrasion index of about 225 or better. In one embodiment, the material for the center portion is HP136X-60A footwear compound and the disk portion is HP100X-65A footwear compound, both purchased from UNIComp, Hampton, N.H.

In yet further foreseen embodiments, the base can be integral with the disk, and the stud integral with the tip. The two components can then be joined by press fitting, spin fitting, ultrasonic welding, coextrusion, bonding or any other joining process. The stud can be metal and joined to the non-metal body by conventional means. The base and the stud can also be integral and formed of metal, with the central portion and the disk attached thereto by known joining methods, including mechanical fastening. Further, the stud can be made of the same material as the disk, with the center portion being fitted therein by known joining processes.

Figure 7:
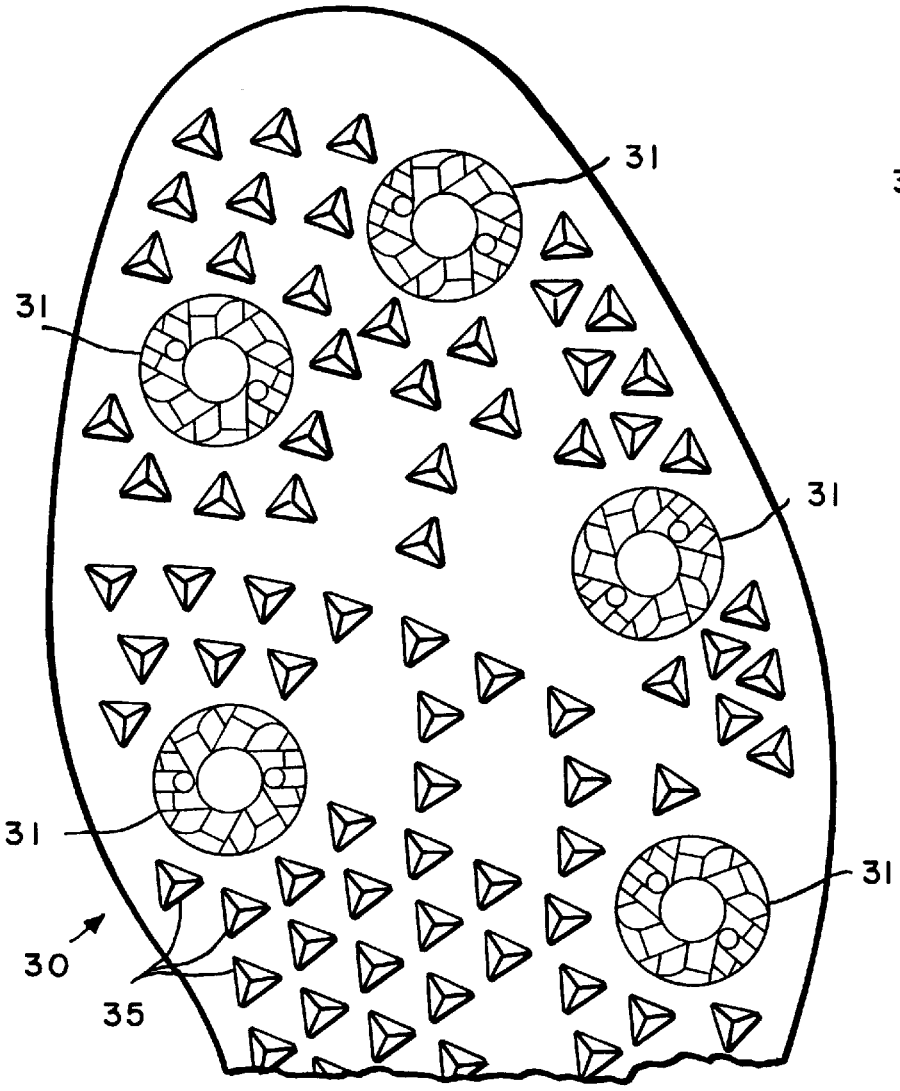
FIG. 7 is a plan view of a sole of a shoe having mounting areas for receiving a plurality of cleats in accord with the present invention.
Figure 8:
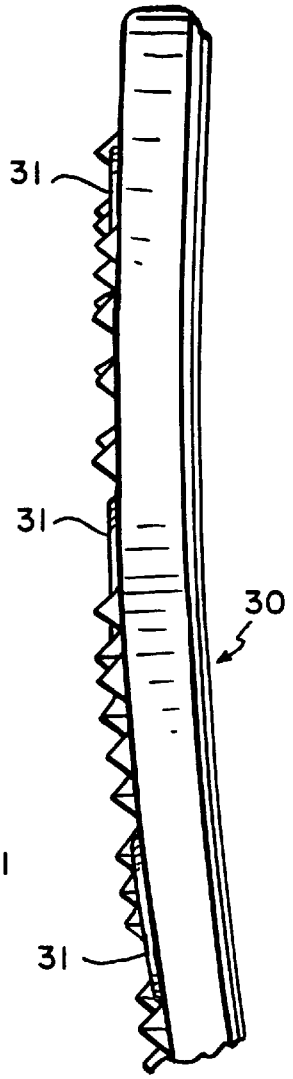
FIG. 8 is a side view illustrating one side of the sole of FIG. 7.

The invention also provides athletic shoes, such as golf shoes, having a plurality of cleats of the present invention mounted in the soles. As illustrated in FIGS. 7 and 8, in accord with the present invention, the sole of an athletic shoe is provided with a plurality mounting areas for the cleats. In the illustrated embodiment, the sole (30) is a molded sole having seven mounting areas (31) for cleats. More or less cleats can be used according to the specific application. Preferably, the sole also has a plurality of integrally molded nubs (35), which can have a variety of shapes. The nubs (35) provide additional stability. The mounting areas include an internally threaded socket for receiving the stud of the cleat. The sockets can be molded of the same material as the sole or can be parts of metal inserts molded into the sole by conventional techniques.

Although the invention has been shown and described in detail including the preferred embodiments thereof, upon consideration of the disclosure including the drawings, those skilled in the art may make various changes, additions and omissions in the form and detail thereof without departing from the spirit and scope of the invention, as set forth in the claims.

What is claimed is:

1. A composite cleat for athletic shoes, said cleat comprising:

a stud having a longitudinal axis for mounting the cleat to the athletic shoe; and a non-metal body comprising two non-metal components attached to said stud;

wherein said non-metal body comprises a first component that substantially surrounds a second center component, the first component being formed of a first material having a first durometer and the second component being formed of a second material having a second durometer softer than the first material.

2. The composite cleat of claim 1, wherein said first component comprises a disk of said first material mounted to said stud on a first major horizontal surface of the disk; and the center portion extends from a second major horizontal surface of said disk.

3. The composite cleat of claim 2, wherein said disk further comprises a plurality of vertical protrusions extending outwardly from said second center component to the circumference of said disk, said protrusions terminating in the longitudinal direction at a vertical height less than said second center component.

4. The composite cleat of claim 3, wherein said second center component has a circular cross-section.

5. The composite cleat of claim 4, wherein said protrusions comprise a first edge defined by a chord extending tangentially from the circumference of said second center component to the circumference of said disk.

6. The composite cleat of claim 3, wherein said protrusions comprise a second edge defined by a fillet joining said second major surface of said disk at a radius thereof to a plane parallel to the first major surface of said disk and a first edge of an adjacent protrusion.

7. An athletic shoe comprising a sole having a plurality of cleats mounted thereon, each cleat comprising:

a stud having a longitudinal axis for mounting the cleat to the athletic shoe; and a non-metal body comprising two components attached to said stud;

wherein a first component substantially surrounds a second center component, the first component being formed of a first material having a first durometer and the second component being formed of a second material having a second durometer softer than the first material.

8. The shoe of claim 7, wherein said first component comprises a disk of said first material mounted to said stud on a first major horizontal surface of the disk; and the center portion extends from a second major horizontal surface of said disk.

9. The shoe claim 8, wherein said disk further comprises a plurality of vertical protrusions extending outwardly from said second center component to the circumference of said disk, said protrusions terminating in the longitudinal direction at a vertical height less than said second center component.

10. The shoe of claim 9, wherein said second center component has a circular cross-section.

11. The shoe of claim 10, wherein said protrusions comprise a first edge defined by a chord extending tangentially from the circumference of said second center component to the circumference of said disk.

12. The shoe of claim 9, wherein said protrusions comprise a second edge defined by a fillet joining said second major surface of said disk at a radius thereof to a plane parallel to the first major surface of said disk and a first edge of an adjacent protrusion.

13. The shoe of claim 7, wherein the sole further comprises a plurality of integrally molded nubs.

14. A golf shoe comprising a sole having a plurality of cleats mounted thereon, each cleat comprising:

a stud having a longitudinal axis for mounting the cleat to the athletic shoe; and a non-metal body comprising two components attached to said stud;

wherein a first component substantially surrounds a second center component, the first component being formed of a first material having a first durometer and the second component being formed of a second material having a second durometer softer than the first material;

wherein said first component comprises a disk of said first material mounted to said stud on a first major horizontal surface of the disk; and the center portion extends from a second major horizontal surface of said disk; and wherein said disk further comprises a plurality of vertical protrusions extending outwardly from said second center component to the circumference of said disk, said protrusions terminating in the longitudinal direction at a vertical height less than said second center component.

15. The golf shoe of claim 14, wherein said second center component has a circular cross-section.

16. The golf shoe of claim 15, wherein said protrusions comprise a first edge defined by a chord extending tangentially from the circumference of said second center component to the circumference of said disk.

17. The golf shoe of claim 14, wherein said protrusions comprise a second edge defined by a fillet joining said second major surface of said disk at a radius thereof to a plane parallel to the first major surface of said disk and a first edge of an adjacent protrusion.

18. The golf shoe of claim 14, wherein the sole further comprises a plurality of integrally molded nubs.

19. An athletic shoe comprising a sole having a plurality of cleats thereon, each cleat comprising:

a non-metal body comprising two non-metal components;

wherein said non-metal body comprises a first component that substantially surrounds a second center component, the first component being formed of a first material having a first durometer and the second component being formed of a second material having a second durometer softer than the first material.

20. The shoe of claim 19, wherein said first component comprises a disk of said first material and the center component extends outwardly from a first major horizontal surface of said disk.

21. The shoe claim 20, wherein said disk further comprises a plurality of vertical protrusions extending outwardly from said second center component to the circumference of said disk, said protrusions terminating in the longitudinal direction at a vertical height less than said second center component.

22. The shoe of claim 21, wherein said second center component has a circular cross-section.

23. The shoe of claim 22, wherein said protrusions comprise a first edge defined by a chord extending tangentially from the circumference of said second center component to the circumference of said disk.

24. The shoe of claim 21, wherein said protrusions comprise a second edge defined by a fillet joining a second major surface of said disk at a radius thereof to a plane parallel to the first major surface of said disk and by a first edge of an adjacent protrusion.

25. The shoe of claim 19, wherein the sole further comprises a plurality of integrally molded nubs.

26. A golf shoe comprising a sole having a plurality of cleats mounted thereon, each cleat comprising:

a non-metal body comprising two components;

wherein a first component substantially surrounds a second center component, the first component being formed of a first material having a first durometer and the second component being formed of a second material having a second durometer softer than the first material;

wherein said first component comprises a disk-shaped region of said first material mounted to said sole and the center portion extends from a first major horizontal surface of said disk; and wherein said disk further comprises a plurality of vertical protrusions extending outwardly from said second center component to the circumference of said disk, said protrusions terminating in the longitudinal direction at a vertical height less than said second center component.

27. The golf shoe of claim 26, wherein said second center component has a circular cross-section.

28. The golf shoe of claim 27, wherein said protrusions comprise a first edge defined by a chord extending tangentially from the circumference of said second center component to the circumference of said disk.

29. The golf shoe of claim 26, wherein said protrusions comprise a second edge defined by a fillet joining a second major surface of said disk at a radius thereof to a plane parallel to the first major surface of said disk and by a first edge of an adjacent protrusion.

30. The golf shoe of claim 26, wherein the sole further comprises a plurality of integrally molded nubs.

* * * * *